US005591015A

United States Patent [19]

Dantlgraber

[11] Patent Number: 5,591,015

[45] Date of Patent: Jan. 7, 1997

[54] CONSTRUCTIONAL UNIT CONSISTING OF A HYDRAULIC MACHINE (HYDRAULIC PUMP OR HYDRAULIC MOTOR) AND A SUPPORT

[75] Inventor: Jorg Dantlgraber, Lohr/Main, Germany

[73] Assignee: Mannesmann Rexroth GmbH, Lohr/Main, Germany

[21] Appl. No.: 437,549

[22] Filed: May 9, 1995

[30] Foreign Application Priority Data

May 10, 1994 [DE] Germany ..... 44 16 449.1

[51] Int. Cl.[6] ..... F04B 39/00

[52] U.S. Cl. ..... 417/312; 417/363; 92/161

[58] Field of Search ..... 92/146, 147, 161; 417/312, 363

[56] References Cited

U.S. PATENT DOCUMENTS

| | | | |
|---|---|---|---|
| 4,306,844 | 12/1981 | Otto et al. | 417/363 |
| 4,309,155 | 1/1982 | Heinz et al. | 417/363 |
| 4,312,627 | 1/1982 | Jacobs et al. | 417/363 |
| 4,362,476 | 12/1982 | Kemmner et al. | 417/363 |
| 4,780,063 | 10/1988 | Tuckey | 417/363 |
| 5,009,579 | 4/1991 | Grant | 417/413 |
| 5,165,867 | 11/1992 | Dockery . | |
| 5,407,330 | 4/1995 | Rimington et al. | 417/312 |

FOREIGN PATENT DOCUMENTS

| | | | |
|---|---|---|---|
| 123140 | 11/1976 | Germany . | |
| 2544536 | 4/1977 | Germany . | |
| 2908407 | 8/1980 | Germany . | |
| 2934666 | 3/1981 | Germany . | |
| 4030126 | 3/1992 | Germany . | |
| 4203619 | 8/1993 | Germany . | |
| 9317524 | 2/1994 | Germany . | |
| 4241827 | 6/1994 | Germany . | |
| 3253800 | 11/1991 | Japan | 417/312 |
| 50-65876 | 3/1993 | Japan | 417/312 |
| 87612 | 10/1936 | Sweden | 417/363 |

OTHER PUBLICATIONS

Der Hydraulik Trainer (The Hydraulic Trainer), vol. 3 cover pp. 3 and 4, 238 and 239 dated 1988 and published by Mannesmann Rexroth GmbH (translation provided).

Grundlagen und Komponenten der Fluidtechnik Hydraulik, Hydraulik Trainer, vol. 1, p. 296, published by Mannesmann Rexroth (1991) No. 29/88 of the periodical "Technische Rundschau" Epucret Chemie GmbH, D-/324 Rechberghausen, in article entitled Reaktionsharzbeton, ein vielversprechender Werkstoff by Hans Schuhmann.

*Primary Examiner*—Thomas E. Denion
*Attorney, Agent, or Firm*—Martin A. Farber

[57] ABSTRACT

A constructional unit comprising a hydraulic machine having a drive or driven shaft and of a support by which the hydraulic machine is held with the interposition of material which deadens solid-conducted noise. Low noise emission of the hydraulic machine is obtained in the manner that the support extends over the hydraulic machine in particular in the direction towards the shaft and that the hydraulic machine is supported on the support via material which deadens solid-conducted noise, present between its outer wall surface and the support. In this way the noise emission can be reduced in a simple manner.

15 Claims, 4 Drawing Sheets

CONSTRUCTIONAL UNIT CONSISTING OF A HYDRAULIC MACHINE (HYDRAULIC PUMP OR HYDRAULIC MOTOR) AND A SUPPORT

FIELD AND BACKGROUND OF THE INVENTION

The present invention proceeds from a constructional unit consisting of a hydraulic machine (hydraulic pump or hydraulic motor) having a drive or driven shaft as well as a support by which the hydraulic machine is held, with the interpositioning of material which deadens solid-conducted sound. An electric motor which drives a hydraulic machine which serves as a hydraulic pump can, for instance, also be fastened on the support. By the solid-conducted-sound deadening material, solid-conducted sound from the hydraulic pump and vibrations are to be prevented from being transmitted from the hydraulic pump to the electric motor and possibly an oil reservoir on which there unit consisting of electric motor and hydraulic pump is arranged.

A hydraulic pump the housing of which is held by a support with the interposition of material which deadens solid-conducted sound is known, for example, from the book "Der Hydraulik Trainer", Vol. I., page 296, 1991, published by Mannesmann Rexroth GmbH. In that hydraulic pump, the sound-deadening material is a profiled rubber ring, which is pressed by means of an annular groove which extends around its outer side onto a radially inwardly directed annular projection on the support. Furthermore, it is clamped axially between a clamping ring and a flange which are screwed together. The housing of the pump is attached at its end to the flange. With this type of attachment, the profiled rubber ring must consist of a relatively hard material, as a result of which the transmission of sound waves and vibrations, particularly in the region of low frequencies, is still not avoided to the extent that is frequently asked for today in the discussion concerning the development of noise in hydraulic systems.

SUMMARY OF THE INVENTION

The object of the present invention is further to develop a constructional unit of the introductorily-mentioned type in such a manner that increased deadening of solid-conducted sound and vibration is possible.

This object is achieved in accordance with the invention by a constructional unit consisting of a hydraulic machine and a support in which, the support grips over the outside of the hydraulic machine particularly in the direction of the shaft, and the hydraulic machine is supported on the support over material which deadens solid-conducted sound, present between the outer wall of the machine and the support. Since, in such a constructional unit, the supporting by the sound-deadening material is effected closer to the center of gravity of the hydraulic machine together with the constructional parts included in it and built on it. The leverage ratio for the supporting is more favorable than in the prior art so that even material which is less hard enters into consideration as material which deadens solid-conducted sound, and good deadening of solid conducted sound and vibration is possible within the entire frequency spectrum.

The leverage ratio for the supporting is particularly favorable if, the hydraulic machine is supported on the support via sound-deadening material in the region of a plane extending through the center of gravity of the machine and perpendicular to its shaft.

Hydraulic machines generally have a more or less creviced outer wall surface so that a moment of reaction acting on the housing of the hydraulic machine upon a rotation of the shaft can be taken up by the sound-deadening material via a physical lock in the manner that the material engages into recesses in the wall surface and covers projections. The moment of resistance can be transmitted from the sound-deadening material to the support with a certainty which goes beyond the physical lock, if, the inner side of the support which radially faces the hydraulic machine is not of rotational symmetry. In particular, a polygonal internal contour of the support is contemplated here.

In principle, individual fingers of the support which extend from a ring by which the support is fastened, for instance, to an electric motor, can engage over the hydraulic machine and hold it fast. For the dimensional stability of the support it, however, appears more favorable if, in accordance with FIG. 4, it extend peripherally around the hydraulic machine and therefore does not have individual fingers which are free on their one end. The stability can also be increased in the manner that, the support is developed in cup shape and has a bottom located in front of one end of the hydraulic machine. It is not absolutely necessary that the entire support consist of a single piece. Rather, a joint between two parts of the support can be present, for instance, in the wall of the cup-shaped support. By a firm attachment between the several parts, high dimensional stability is nevertheless obtained.

The support may in particularly advantageous manner consist of a reaction resin concrete. This material is described in detail, also with regard to its uses, in, for instance, Issue No. 29/88 of the Journal, "Technische Rundschau, " and is available on the market. It offers advantages with respect to shaping and weight over metals. Furthermore, it also contributes to the deadening of solid-conducted noise and vibration, and thus to a reduction in the noise of a hydraulic machine. Therefore, its use can be advantageous already also in the case of a traditional supporting.

It is favorable if the axial position of the hydraulic machine is assured in form-locked manner via a physical lock, on the one hand, between it and the sound-deadening material and, on the other hand, between the sound-deadening material and the support, or even without a physical lock. According to the features of the invention this form-lock may suitably be produced.

BRIEF DESCRIPTION OF THE DRAWINGS

With the above and other objects and other advantages in view, the present invention will become more clearly understood in connection with the detailed description of preferred embodiments, and other advantageous features, when considered with the accompanying drawings of which.

In the drawing.

DETAILED DESCRIPTION OF THE PREFERRED EMBODIMENTS

Figure 1:
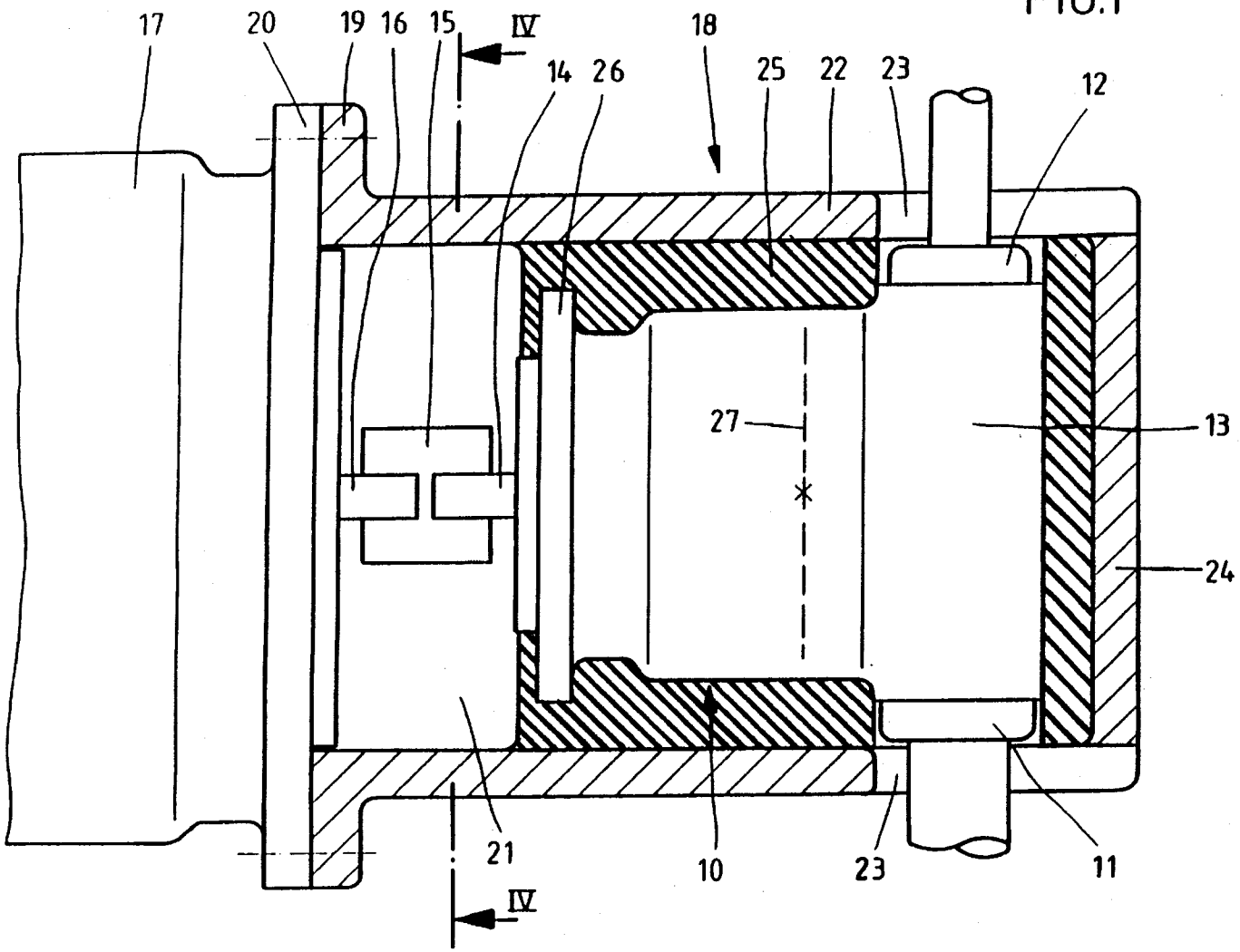
FIG. 1 shows the first embodiment which has a single-piece cup-shaped support, the hydraulic machine being shown in outer view and the support, as well as sound-deadening material between the support and the hydraulic machine being shown in section.
Figure 2:
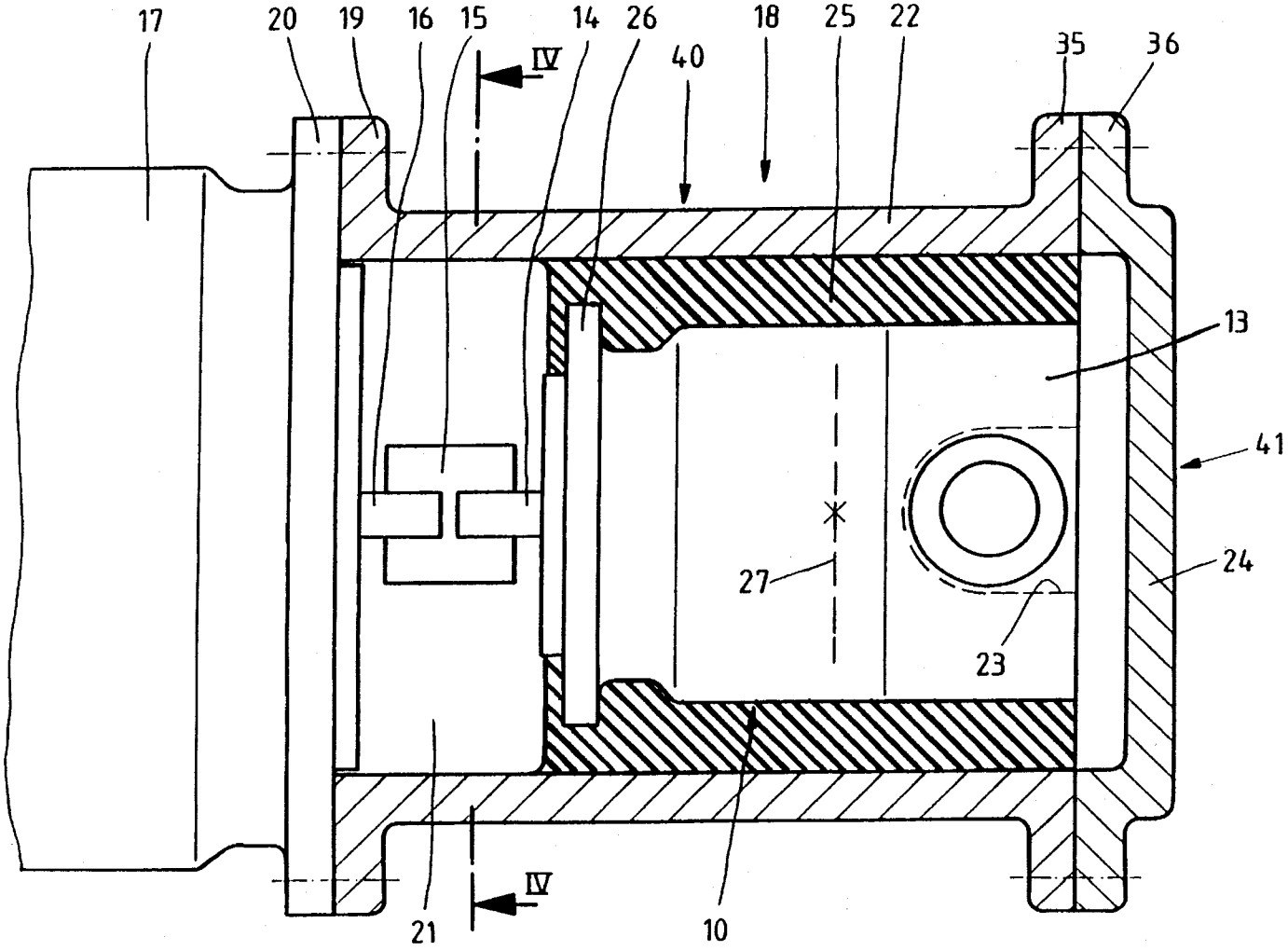
FIG. 2 shows, in a view similar to FIG. 1, a second embodiment in which the support is developed in two pieces.

In all embodiments the hydraulic machine is a hydraulic pump 10 which is provided with a suction connection 11 and a pressure connection 12 located opposite it, with a drive shaft 14 extending out of its housing 13. The drive shaft 14, shown only in FIGS. 1 and 2, is connected via a flexible clutch 15 with the shaft 16 of an electric motor 17. The hydraulic pump 10 can therefore be driven by the electric motor 17.

In order that solid-conducted sound and vibrations are not transmitted, or transmitted only to a very limited extent, from the hydraulic pump 10 to the electric motor 17, the hydraulic pump is fastened in a special manner to the electric motor. In the embodiment shown in FIG. 1, the fastening is effected by a single-piece, cup-shaped support 18 the length of which in the direction of the drive shaft 14 of the hydraulic pump 10 is greater than the length of the hydraulic pump, the support extending beyond the hydraulic pump in the direction towards the electric motor 17. On the edge of the cup, the support 18 is provided with an outer flange 19 with which it can be bolted to a flange 20 of the electric motor. The rotationally flexible clutch 15 is arranged in the free space 21 created by the protrusion of the support 18 beyond the hydraulic pump 10. In its wall 22, the support 18 has two oppositely located openings 23, open axially on one side, through which openings conduits can be connected to the suction connection 11 and pressure connection 12 respectively of the hydraulic pump 10. The bottom 24 of the support 18 is arranged at a slight distance from the hydraulic pump 10.

The support 18 consists of a reaction resin concrete. Its production is therefore particularly simple. First of all, the different components of the material are mixed together. They are then poured into a mold, in which connection no pressure need be exerted and no temperature treatment is required. The material hardens in the mold within a period of hours without special treatment.

Figure 4:
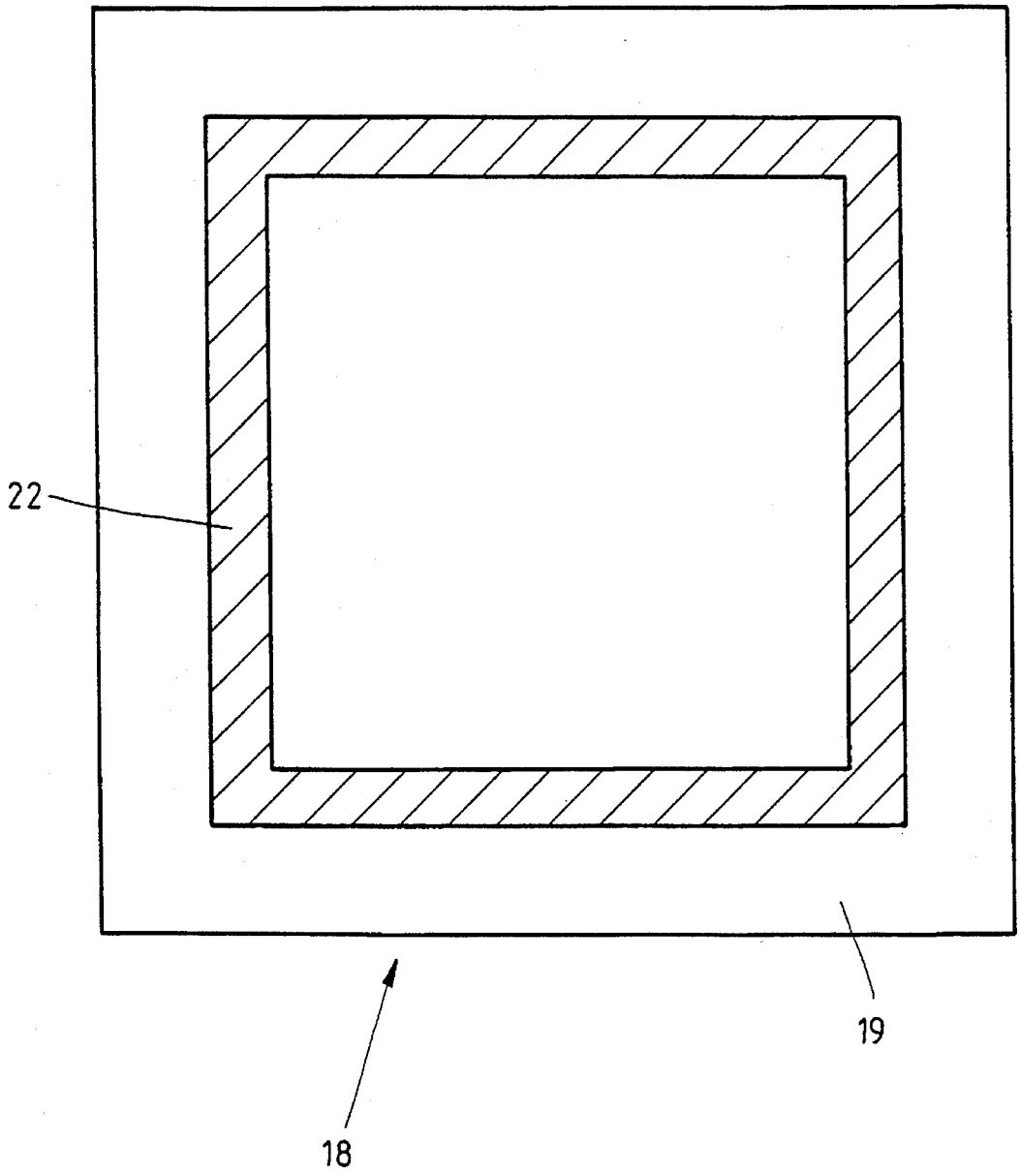
FIG. 4 is a section along the line IV—IV of FIGS. 1 and 2.

The hydraulic pump 10 is located within the cup-shaped support 18 and is supported via rubber-like material 25 which deadens solid-conducted noise, the material being located radially between the hydraulic pump 10 and the wall 22, as well as axially between the hydraulic pump 10 and the bottom 24 of the support 18. The material 25 is injected into the spaces between the hydraulic pump 10 and the support 18 and fills these spaces up to the free space 21 and up to clearances around the connections 11 and 12. Among other things, the material 25 also extends over a pump flange 26 on the end of the hydraulic pump 10 facing the electric motor 17. Due to the fact that the sound-deadening material 25 completely covers the surface of the hydraulic pump 10, including all recesses and projections with the exception of the free spaces at the connections 11 and 12, it is connected with the hydraulic pump 10 both in axial and peripheral direction not only by a physical lock based on an adherence effect in addition to a force-lock, but also by a form lock with the hydraulic pump 10. A form-lock is present between the sound-deadening material 25 and the support 18 in the one axial direction as a result of the bottom 24, while in the other axial direction towards the electric motor 17 there is a connection by physical-lock and force-lock. In peripheral direction, as can clearly be noted from FIG. 4, the support 18 is of square shape on the inside, so that moments of reaction can readily be transmitted from the material 25 to the support 18.

The radial supporting of the hydraulic pump 10 on the support 18 is effected via the sound-deadening material 25, in particular also in the region of a plane 27 which extends perpendicular to the shaft 14 and through the center of gravity of the hydraulic pump 10. The leverage ratio for the support by the material 25 is therefore very favorable, so that a relatively soft material 25 which has good damping properties in the entire frequency spectrum of the sound waves can be used.

Since the material used for the support 18 also has damping properties, solid-transmitted sound from the hydraulic pump 10 is transmitted only in greatly damped manner to the electric motor 17. Furthermore, it can readily be seen from FIG. 1 that, by means of the support 18, there is practically complete encapsulation of the hydraulic pump 10 so that, as compared with known constructional units, the radiating of airborne sound is also reduced and a constructional unit is created which is characterized by very low noise emission.

The embodiment shown in FIG. 2, in which the hydraulic pump 10 is turned 90° as compared with FIG. 1, corresponds almost entirely to the embodiment shown in FIG. 1, so that the description of the embodiment of FIG. 1, with the corresponding reference numerals, can substantially be used. Differing from the embodiment of FIG. 1, in the case of FIG. 2 the support 18 is developed in two parts, the one part 40 comprising substantially the wall 22 and the fastening flange 19 and the other part 41 comprising the bottom 24. The two parts 40 and 41 of the support 18 have outer flanges 35 and 36 respectively which rest against each other and on which the two parts are screwed to each other. The openings 23 which are shown in dashed line in FIG. 2 are open axially towards the parting surface between the two parts of the support 18. In principle, the openings 23 can, however, also be circular holes in the wall 22 of the support 18. The fact that, in the embodiment of FIG. 2, the support consists of two pieces makes it possible to keep the space between the hydraulic pump 10 and the bottom 24 free upon the injection of the material 25. Only after the material 25 has been introduced is the bottom 24 placed on the wall 22 of the support 18.

Figure 3:
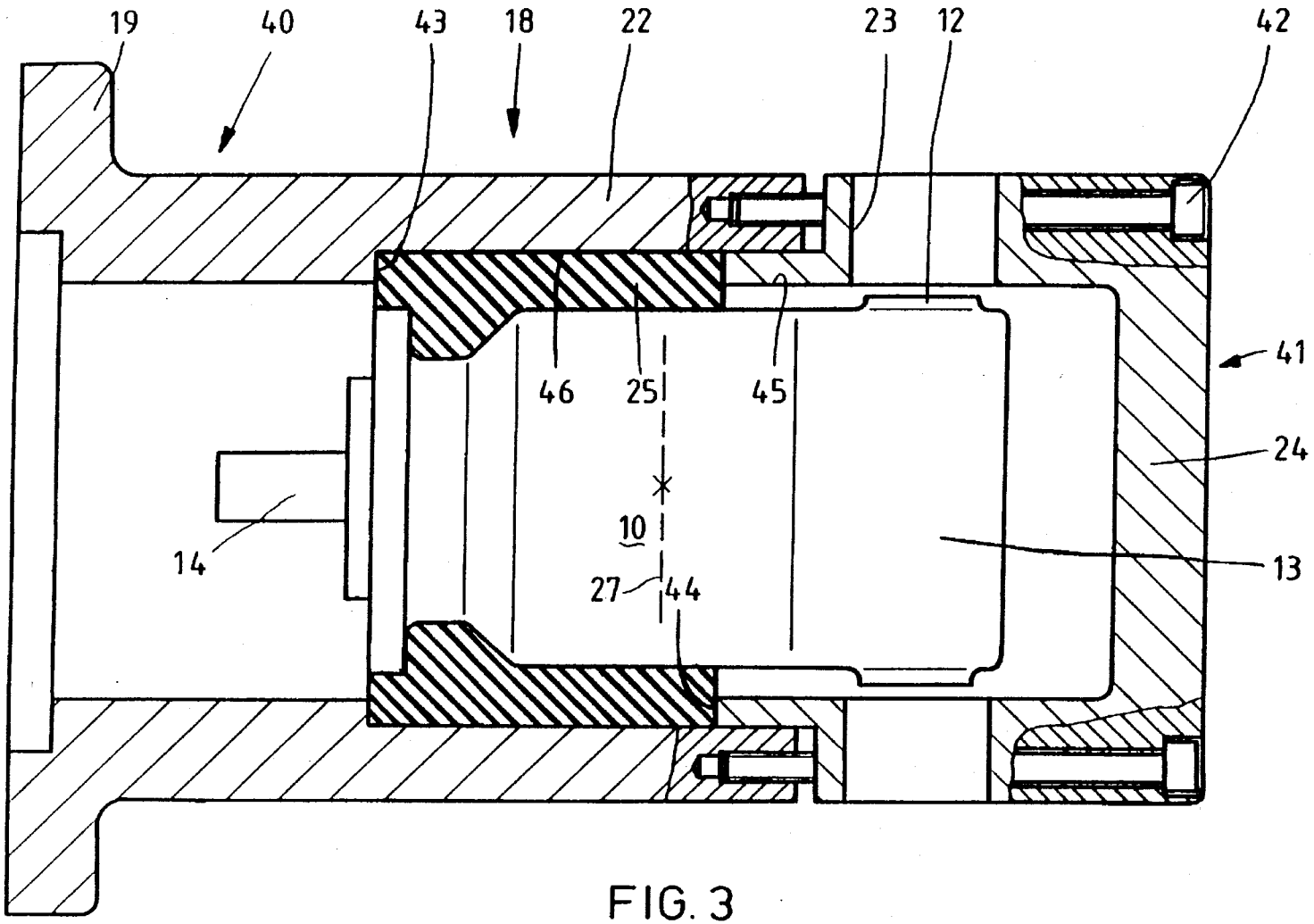
FIG. 3 shows in the same type of view as in FIGS. 1 and 2, a third embodiment, the support of which is also developed in two pieces and which has an inner annular groove filled with sound-deadening material.

In the embodiment of FIG. 3, the support 18 is also developed in two parts, namely the parts 40 and 41, in which connection, however, the parting surfaces between the two parts 40 and 41 are now axially further away from the bottom 24 and the one part 40 comprises the flange 19 and the section of the wall 22 supporting the pump 10, and the other part 41 comprises the bottom 24 and a further section of the wall 22 in which the openings 23, now developed as circular holes, are located. The parting surfaces between the two parts 40 and 41 of the support are stepped, so that the part 41 is centered on the part 40. The two parts 40 and 41 are fastened to each other by screws 42 which extend axially through the part 41 and are screwed into the wall 22 of the part 40.

By means of an inner shoulder 43 on the part 40 and by means of a second inner shoulder 44, which is formed by the end side on a collar 45 of the support part 41 which extends axially into the part 40 a circumferential groove 46 which is open towards the hydraulic pump 10 has been created on the inside on the support 18, said groove being completely filled with the sound-deadening material 25 which is present between the support 18 and the hydraulic pump 10. In this way, a form lock is produced in axial direction between the support 18 and the material 25. The bipartite construction of the support 18 as well as the development of the one inner shoulder 44 on the support part 41 not only brings it about that the groove 26 can be produced without undercutting on one or the other support part but also offers a further advantage. The elastic material 25 is introduced before the attachment of the support 41 to the support part 40, in which connection its axial length towards the rear in the direction in which the inner shoulder 44 points can be made so large that the inner shoulder 44 on the support 41 strikes against the material 25 before the support part 41 strikes against the support 40. By a different degree of tightening of the screws 42, the material can now be prestressed axially by different amounts and in this way the characteristics of the support can be controlled.

Also in the embodiment shown in FIG. 3 it is seen to it that the hydraulic pump 10 is supported by elastic material 25 in the region of the plane 27 passing through the center of gravity.

I claim:

1. A constructional unit comprising a hydraulic pump having a drive shaft, solid conducted noise dampening material, and a drive motor by which the hydraulic pump is drivable via the drive shaft, and a support via which the hydraulic pump is held on the drive motor, with interpositioning of the solid conducted noise dampening material which deadens solid-conducted noise, wherein the support engages with an outside of the hydraulic pump in a direction of the shaft, and the hydraulic pump is supported on the support via the solid conducted noise dampening material, the solid conducted noise dampening material being interposed between an outer wall surface of the pump and the support.

2. A constructional unit according to claim 1, wherein a center of gravity of the hydraulic pump is located on an axis of the shaft, in a region of a plane extending through the center of gravity and perpendicular to the shaft, the hydraulic pump is supported on the support via the solid-conducted-noise deadening material.

3. A constructional unit according to claim 1, wherein an inner side of the support radially faces the hydraulic pump, and is of rotational symmetry.

4. A constructional unit according to claim 1, wherein the support extends peripherally around the hydraulic pump.

5. A constructional unit according to claim 4, wherein the support has a cup shape including a bottom disposed in front of one end of the hydraulic pump.

6. A constructional unit according to claim 1, wherein the material of the support comprises a reaction resin concrete.

7. A constructional unit according to claim 4, wherein the solid-conducted noise deadening material extends peripherally around the hydraulic pump.

8. A constructional unit according to claim 7, wherein the hydraulic pump has an axial flange which is surrounded by the solid-conducted noise-deadening material.

9. A constructional unit according to claim 5, wherein the solid-conducted noise-deadening material is present between the hydraulic pump and the bottom of the cup-shaped support.

10. A constructional unit according to claim 7, wherein the support has at least one inner shoulder for an axial application of the solid-conducted noise-deadening material.

11. A constructional unit according to claim 10, wherein the support has two inner shoulders, and an inner groove which is axially limited by the two inner shoulders, the support being filled with solid-conducted noise-deadening material.

12. A constructional unit according to claim 10, wherein the support has at least two support parts, of said at least one inner shoulder is displaceable by changing the position of one of said support parts with respect to the position of the other support part.

13. A constructional unit according to claim 4, wherein the solid-conducted noise-deadening material is an injectable material for injection into a space between the hydraulic pump and the support.

14. Construction unit according to claim 2, wherein an inner side of the support, which side radially faces the hydraulic pump, is rotationally-asymmetrical.

15. Construction unit according to claim 11, wherein the support comprises at least two support parts, and one of said inner shoulders is displaceable by a changing of a position of one of said support parts with respect to the other of said support parts.

* * * * *